US005564693A

United States Patent [19]

Elkis et al.

[11] Patent Number: 5,564,693

[45] Date of Patent: Oct. 15, 1996

[54] PAPERBOARD PROCESSING MACHINE WITH VACUUM TRANSFER SYSTEM

[75] Inventors: Mikhail Elkis, Columbia; James M. Kowalewski; Mark R. Donovan, both of Baltimore; John H. P. Andrews, Monkton, all of Md.

[73] Assignee: Ward Holding Company, Inc., Wilmington, Del.

[21] Appl. No.: 384,312

[22] Filed: Feb. 1, 1995

[51] Int. Cl.[6] ..... B65H 5/02

[52] U.S. Cl. ..... 271/276; 271/197; 198/689.1

[58] Field of Search ..... 271/276, 194, 271/196, 197; 101/424.1; 198/689.1; 34/659, 663

[56] References Cited

U.S. PATENT DOCUMENTS

| | | | |
|---|---|---|---|
| 1,669,066 | 5/1928 | Murck | 34/663 |
| 2,384,155 | 9/1945 | Brunk | 34/663 |
| 4,526,360 | 7/1985 | Focke | 271/197 |
| 4,745,432 | 5/1988 | Langdon | 271/197 |
| 5,004,221 | 4/1991 | Stark | 271/194 |
| 5,163,891 | 11/1992 | Goldsborough et al. | 493/321 |
| 5,383,392 | 1/1995 | Kowalewski et al. | 101/183 |
| 5,467,180 | 11/1995 | Malachowski et al. | 271/276 |

*Primary Examiner*—H. Grant Skaggs
*Attorney, Agent, or Firm*—Edward D. C. Bartlett; Ronald B. Sherer

[57] ABSTRACT

A paperboard processing machine is disclosed for printing and otherwise processing sheets of paperboard, such as corrugated container blanks, and in which the sheets are conveyed from one section of the machine to another section by one or more vacuum transfer systems. Each vacuum transfer system comprises an enclosure which is closed by a closure plate for creating a subatmospheric pressure, which pressure forces the sheets into frictional engagement with the reaches of a plurality of conveyor belts whereby the sheets are transported without contact of the opposite side of the sheet not contacted by the conveyor reach. In one embodiment the closure plate is imperforate, while in the second embodiment the closure plate is provided with a limited number of apertures for providing a secondary flow of air upwardly against the bottom surfaces of the paperboard sheets. In addition, in one preferred embodiment, a plurality of slots are provided in the closure plate for reducing the inflow of air at the entrance and exit ends of the transfer section.

17 Claims, 7 Drawing Sheets

PAPERBOARD PROCESSING MACHINE WITH VACUUM TRANSFER SYSTEM

FIELD OF THE INVENTION

This invention relates to machines for printing and otherwise processing sheets of paperboard, such as carton blanks and, more particularly, the present invention relates to a high-speed vacuum transfer conveyor system for transporting such carton blanks between adjacent processing sections of the machine.

BACKGROUND

In the printing of carton blanks, such as those composed of corrugated paperboard, for example, it is well known to apply ink impressions to the blanks with high speed flexographic rollers, and then to transport such inked carton blanks to the next section of the machine by the use of pull rollers which engage the upper and lower surfaces of the inked blanks. However, as the speeds of such machines have increased, and the quality of the ink impressions has become critical, a serious need has arisen to be able to transport the freshly inked blanks to the adjacent section of the machine without contacting the surface of the blank having the moist ink impression. In efforts to solve this problem, a number of transfer systems have been developed in which vacuum boxes are located between the upper and lower reaches of conveyors. The boxes have vacuum slots which communicate with vacuum apertures in the belts, such that, a partial vacuum pressure is applied to the blanks when the apertures in the belts are aligned with the slots in the vacuum boxes. One such system is described in co-pending Application Ser. No. 08/033,097 now U.S. Pat. No. 5,383,392. Such systems are effective in transporting the carton blanks without contacting the inked surface; however, the force applied to the blanks is limited by the size of the apertures in the belts, and such apertures may not be made unduly large or they weaken the strength of the belt. Also, relatively low vacuum pressures are required and this, in turn, required relatively expensive vacuum pumps. Registration correction of the blanks is also made more difficult than if the belts did not require such vacuum apertures as will be further explained hereinafter.

A second type of transfer system, known as an open-flow system, has also been developed in which axial flow fans or blowers are utilized to create very large mass flows of air upwardly through a transfer zone between sections of the machine. Solid conveyor belts are provided in this transfer zone, and the high mass flow of air forces the blanks upwardly against the lower reaches of the conveyor as described in U.S. Pat. No. 5,163,891, or against a plurality of drive rollers as taught in U.S. Pat. No. 5,004,221. These systems eliminate the problems associated with the belt apertures; however, they require very high rates of mass flow which can create problems of excessive dust-flow within the machine, as well as undesirable noise and vibration levels.

SUMMARY

The present invention solves all of the above problems by providing an enclosed space of subatmospheric pressure through which solid conveyor belts extend. In one embodiment, the bottom of the enclosed space is closed with a solid, impervious closure plate. In a second embodiment, the closure plate is provided with a limited number of airflow apertures. In both embodiments, the primary airflow into the subatmospheric space is through restricted openings which are located adjacent the entrance and exit ends of the conveyors. As a result, the vacuum apertures in the belts are eliminated, and only relatively low air flows are required. These and other objects of the invention will become apparent from the following description of one preferred embodiment illustrated in the following drawings.

DETAILED DESCRIPTION

Figure 1:
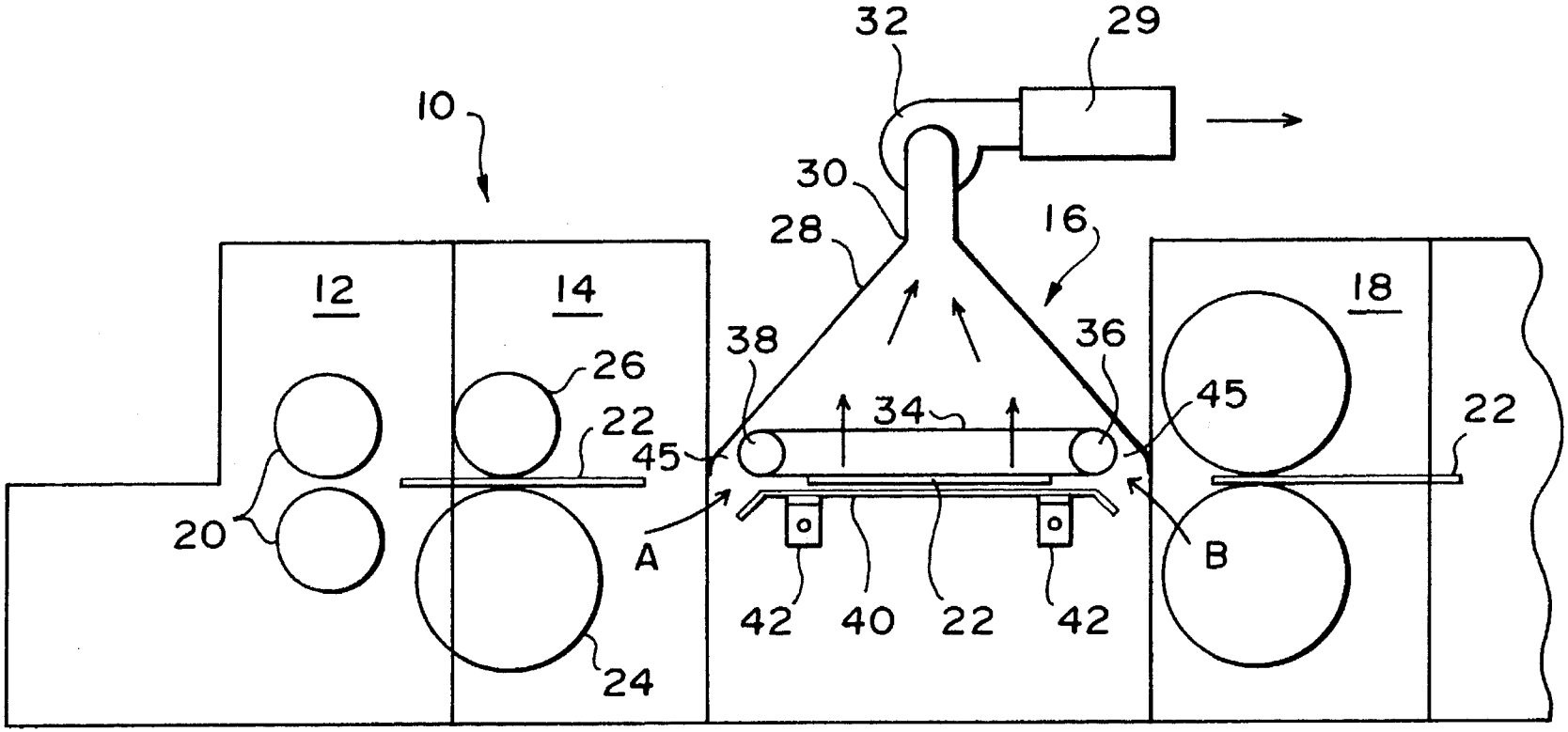
FIG. 1 is a schematic side view of the machine.

Referring first to FIG. 1, a carton blank printing and processing machine 10 is shown schematically as comprising a feed section 12, a printing section 14, a transfer section 16, and at least one further downstream processing section, such as a die cutter section 18, for example. Of course, it will also be understood that other downstream sections may also be present such as tab cutting and glue/folding sections not shown. Feed rollers 20 feed carton blanks 22, sometimes referred to herein as sheets, from feed section 12 to printing section 14 in which the blanks pass between a print roll 24, and an impression roll 26. From printing section 14 the carton blanks 22 may pass to additional printing sections (not shown), or as shown in the simplified illustration of FIG. 1, the blanks pass to a transfer section 16 which conveys the blanks to die cutter section 18, or to such other processing section as may be adjacent the last stage of the printing section.

The primary purpose of providing an elongated transfer section, as opposed to providing feed rolls for passing the blanks directly from the printing section to the adjacent section, is to provide additional time for the ink impressions on the blanks to dry more completely before entering the next section. In the illustrated embodiment, it will be apparent that the wet ink is on the bottom sides of the carton blanks coming off print roll 24 such that it is desired to have air flow, and possibly radiant heat, directed at the bottom sides of the blanks. However, the bottom sides of the blanks must not be otherwise contacted during passage through the transfer/drying section 16 lest the ink impressions be smeared.

Figure 2:
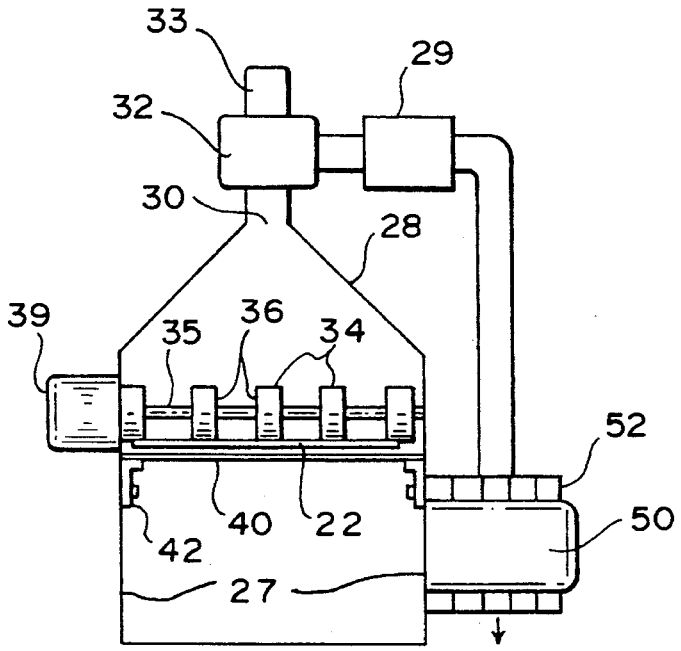
FIG. 2 is a schematic end view of the machine.

To effect such transport of the carton blanks, as illustrated schematically in the embodiment of FIGS. 1 and 2, the present invention provides a hood 28 which may be secured to side walls, not shown, or to the adjacent sections of the processing machine. Hood 28 is generally in the shape of a pyramid, with an air-flow outlet 30 at the top connected to the inlet of a blower 32, which may be driven by a variable speed motor 33. Blower 32 is preferably of the center inlet-peripheral discharge type or vaneaxial type, and preferably discharges through a sound attenuator 29. At the bottom edge of hood 28, a plurality of horizontally extending conveyor belts 34 are mounted on drive pulleys 36 and idler pulleys 38; drive pulleys 36 being driven by motor 39 through shaft 35 as illustrated in FIG. 2. The front and rear bottom edges of the hood are positioned close to pulleys 36 and 38, such as in the order of one inch or less, and the bottom of the side edges extend down to or slightly below the line of travel of the blanks so as to fully surround the conveyors. In the FIG. 1 embodiment, the entire bottom of the hood is closed by an impervious plate 40 which extends the full width of the hood and extends to or beyond the front and rear turnarounds of the belts.

With the almost completely enclosed hood-and-plate structure just described it will be understood that, when blower 32 is operating, a subatmospheric pressure is created within hood 28, and the only path for the flow of atmospheric air into the hood is through the severely restricted slotted openings 45 formed between plate 40 and the bottom edges of the hood at the inlet and exit ends of the transfer section; such restricted flow being shown by arrows A and B. This creates a substantial pressure differential between the bottom and top sides of the blanks, as will be more fully described hereinafter, such that the blanks are forced upwardly against the bottom reaches of the conveyor belts. The surfaces of the belts are composed of a material having a high coefficient of friction such that the blanks are forced into firm frictional contact with the bottom reaches of the belts. Thus, the blanks may be transported through the transfer/dryer section, which may be in the order of 3 to 5 feet in length, without slippage, and at very high speeds such as in the order of 1,000 feet per minute.

In understanding the fluid dynamics of the present invention, it is to be noted that the provision of baffle or closure plate 40 is of particular significance in that it not only effectively closes the bottom of the hood, thereby substantially reducing the mass-flow which must be effected by the blower, but in addition, plate 40 creates a relatively dead-air zone immediately below the blanks. That is, as each blank moves through the transfer section, there is only a nominal clearance space between the bottom surface of the blank and the top surface of the closure plate; such clearance space being in the order of ¼ to 1 inch. In this restricted clearance zone, the air under each blank is in communication with atmospheric air at both ends and both sides of the blank such that the pressure of the air in this restricted clearance zone is essentially full atmospheric pressure whereby the maximum static pressure is exerted upwardly against the bottom surface of the blank. Thus, closure plate 40 makes it possible to obtain very tight adherence of the blank against the belts, and by substantially reducing the mass-flow which would otherwise be required to achieve this high level of adherence. In this regard, while the preferred embodiment illustrates the use of a centrifugal blower, or a vaneaxial fan may be used, it is to be understood that an axial flow fan may also be used. However, it has been discovered that a centrifugal blower or vaneaxial fan is greatly preferred because pure axial flow fans require the movement of massive amounts of air in order to create the desired degree of subatmospheric pressure in the hood; such subatmospheric pressure being, for example, in the range of 2 to 4 inches of water. This is highly undesirable in the environment of a printing machine because such massive volumes of air movement can create dust problems which may contaminate the ink impressions, as well as causing excessive noise and vibrations. Thus, the combination of a centrifugal blower with an essentially closed hood has been discovered to provide the necessary degree of subatmospheric pressure with substantially lower, more acceptable mass flow and power requirements.

Referring back to FIG. 2, after the exhaust air passes through sound attenuator 29, the preferred embodiment of the present invention provides the further improvement of cooling one or more of the motors. The motor may be motor 50 which drives the print rolls, and/or the motor driving the die cutter rolls or the transfer belts. This cooling is performed by passing the exhaust air from blower 32 through a finned jacket 52 which surrounds the motor(s). In this manner, the previously required water-cooled jackets and expensive liquid cooling pumps may be eliminated; thereby further reducing the power requirements of the total system. Alternatively, or in addition, some or all of the exhaust air may be recirculated to the transfer section as will be more fully described hereinafter.

The present invention also simplifies the system required for registration correction of the blanks in that, since the belts of the present invention do not require vacuum apertures, a registration correction may be made as taught, for example, in co-pending Application Ser. No. 08/033,097 without the added requirement to correct the linear position of the belts thereafter.

Figure 3:
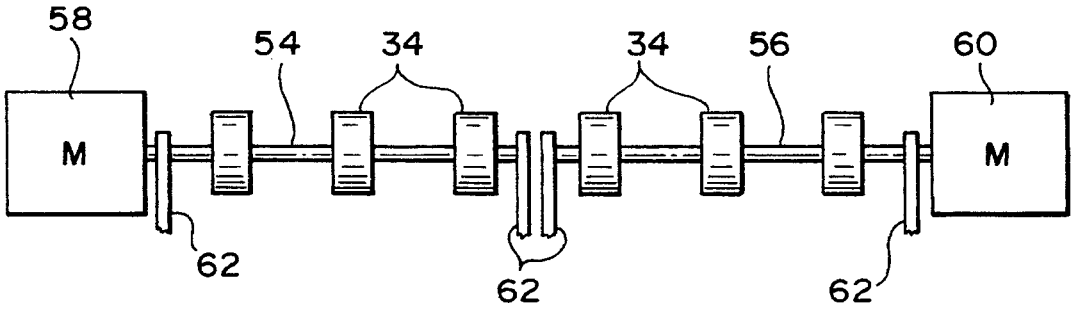
FIG. 3 is an enlarged schematic view of the conveyor and motor structure.

The present invention also facilitates skew correction in that belts 34 do not require vacuum apertures such that the belts on one side of the longitudinal center of the machine may be speeded up or retarded relative to the other side. This is illustrated in FIG. 3 wherein drive shaft 35 is replaced by two separate drive shafts 54 and 56, each driven by a separate servo motor 58, 60; shafts 54, 56 being supported by suitable support bars 62 and bearings not shown. As a result, skew correction may be accomplished by increasing the speed of one of the drive shafts relative to the other, and then returning the speed of that shaft to that of the other shaft once the skew of that particular blank has been eliminated.

In addition to the use of transfer section 16 between the printing section and the adjacent processing section, the transfer section of the present invention may be used between any two adjacent processing sections such as, for example, between the die cutter section and an adjacent glue/folder section, slotter section, or other section. Furthermore, it has been discovered that the transfer section of the present invention may be used between multiple printing sections, as illustrated schematically in FIG. 4, thereby eliminating the expensive feed rolls and controls, and also separating the dynamic feed and cutter sections from the steady state printing function. The components of the transfer systems in FIG. 4 may be generally the same as those previously described, and are noted with the same numerals, except that the lengths of the systems are significantly shorter; ie, in the order of 1 to 2 feet so as to fit between adjacent print rolls. Also, because of their small size, two or more of the hoods 28 may be manifolded to a single blower 32 if desired, and the direction of the air flow going to the closure plate may be different as will be more fully described hereinafter.

The embodiment described hereinabove is particularly effective in the transfer of relatively large carton blanks such as blanks which have widths in the order of fifty percent or more of the width of the transfer section. However, printing and processing machines as described hereinabove are frequently used to print and otherwise process blanks of widely varying size, including for example, blanks for small cartons which may have a width of only one-quarter or less of the width of the transfer section; ie, one-quarter or less of the width of closure plate 40. With blanks this small, the air above and below the blank comes into open communication through the large area around the side edges of the blank, as well as around the leading and trailing edges of the short blank, such that the pressure differential across the blank tends to decrease. This may be offset in several ways including, for example, increasing the speed of the blower; however, this increases the mass flow and the energy requirements. Also, it has been found that it is desirable to minimize the mass flow particularly in the area of the print rolls, and also in the areas immediately adjacent the print rolls so as to avoid dust contamination and avoid excessive drying of the ink on the ink rolls. Therefore, a second embodiment of the present invention will now be described as follows.

Figure 5:
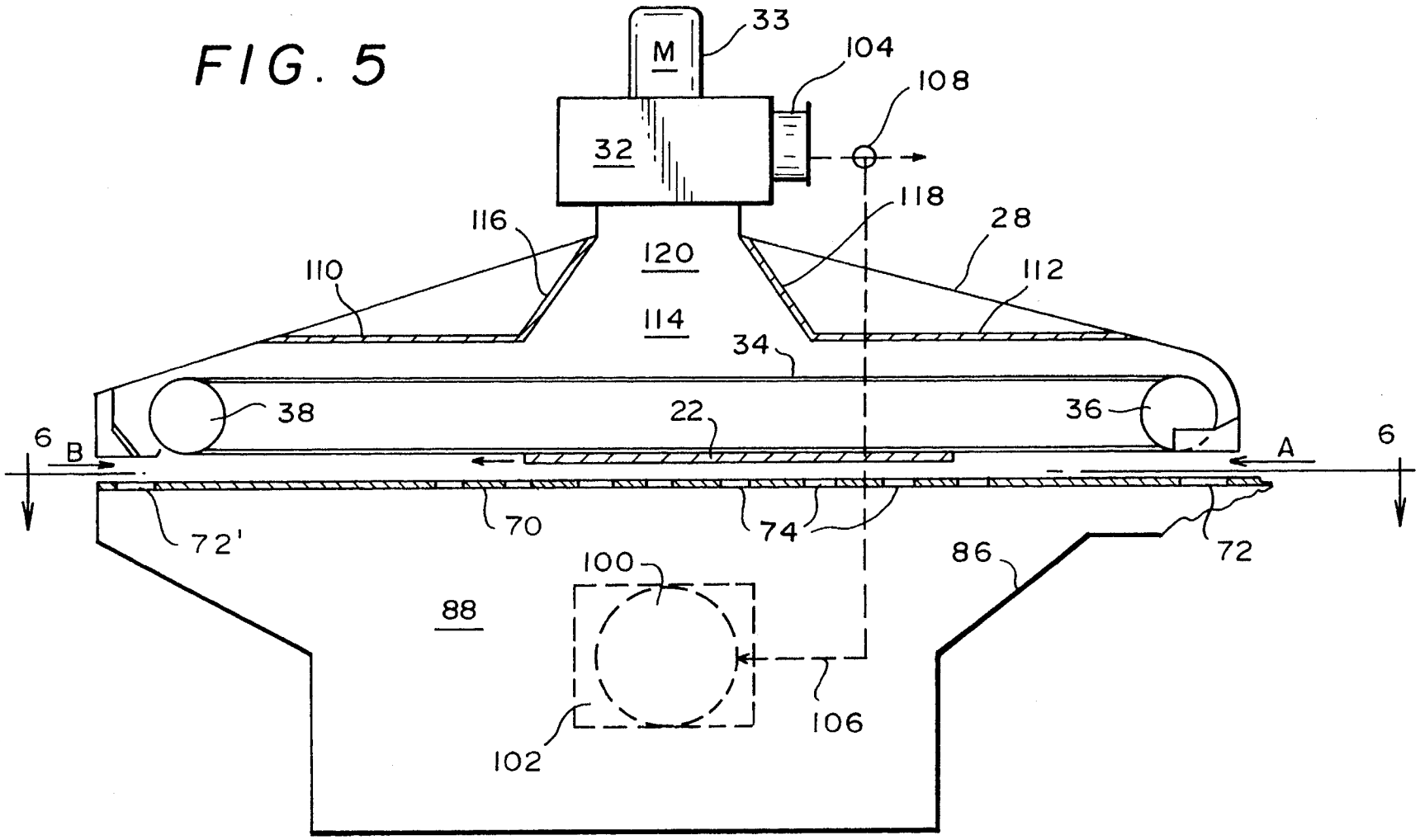
FIG. 5 is a schematic side view of an alternative form of the present invention.
Figure 6:
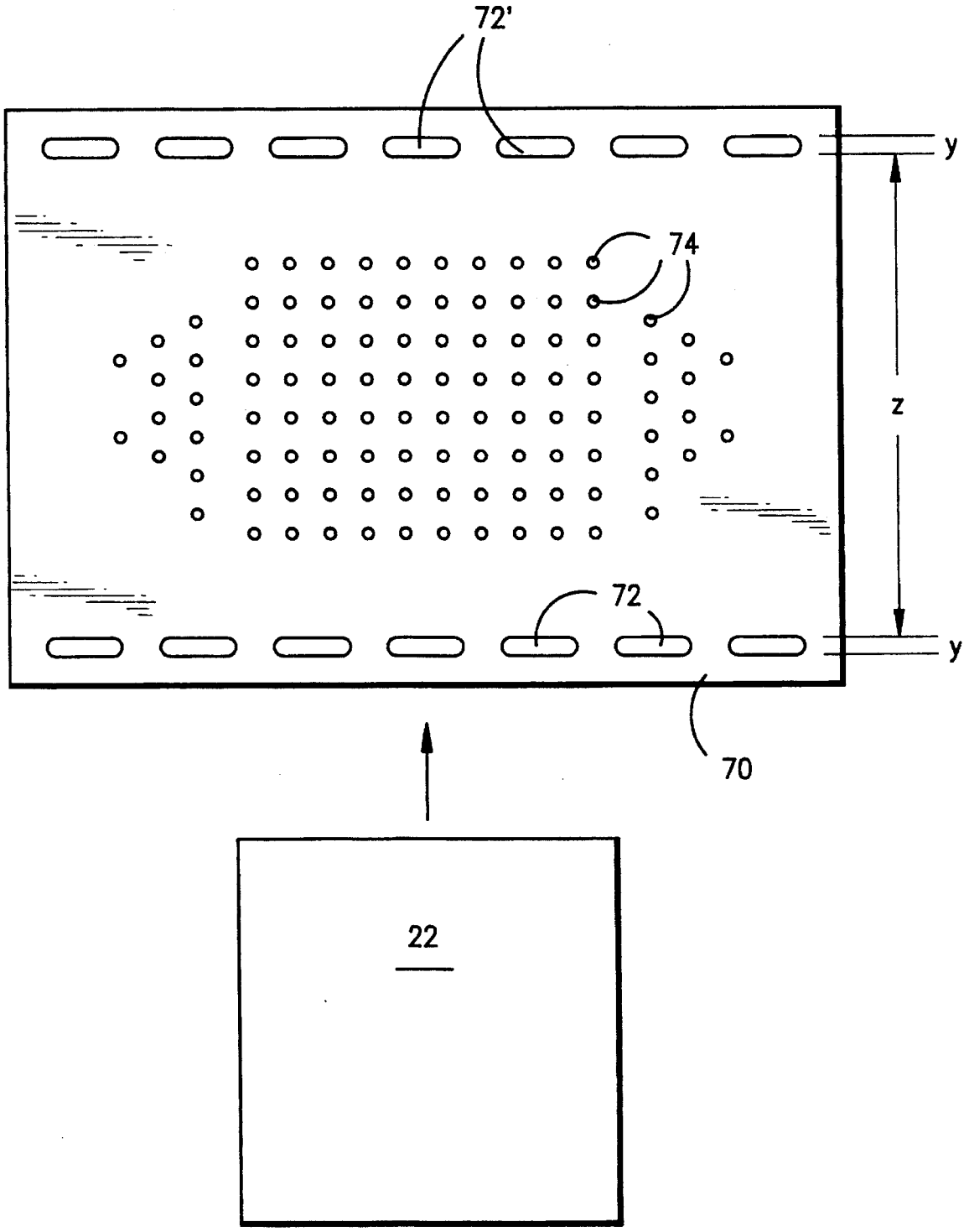
FIG. 6 is a top plan view of the closure plate taken along view line 6—6 of FIG. 5.

In the embodiment illustrated in FIGS. 5 and 6, the same elements have been designated with the same numerals as in the FIG. 1 embodiment and they function as previously described. However, in this embodiment, solid closure plate 40 is replaced by a perforated closure plate 70. Perforated closure plate 70 is provided with slots 72 and 72' at the entrance and exit ends, respectively, and a plurality of apertures 74 in the central region of the closure plate. Apertures 74 are preferably positioned with the highest density in the center portion of the plate with a less dense distribution extending outwardly toward the sides of the plate, and with a marginal plate portion with few or no apertures as illustrated in FIG. 6. This distribution with more apertures in the center of the plate and less in the side portions has been shown to produce excellent engagement of various sized corrugated blanks with the bottom of the lower reach of the conveyor. Tests have also shown that from 20 apertures of 2.5 inch diameter to over 100 apertures of 1.25 inch diameter have performed very well in maintaining the advantageous effect of a solid plate in terms of providing low mass flow, while at the same time, creating a strong pressure differential across the carton blanks to maintain the blanks in firm frictional contact with the lower reach of the conveyor even in the case of small carton blanks of the size previously discussed. Stated otherwise, it has been determined that the total cross-sectional area of all of the apertures should be in the order of 1% to 10% of the cross-sectional area of the plate between slots 72, 72'; ie, the width of the plate times the distance z shown in FIG. 6, and preferably, in the order of 1.5% to 5% of the area of the plate between slots 72 and 72'.

The purpose of slots 72 at the entrance and slots 72' at the exit end of the plate is two-fold. First, the slots provide an upwardly directed flow of air perpendicularly against the bottom sides of the blanks. This air flow also reduces the amount of air which would otherwise flow horizontally into the transfer section from adjacent sections of the machine. That is, as shown more clearly in the enlarged, fragmentary view of FIG. 7, the upward flow of air through slot 72 at the inlet opening of the machine reduces the amount of horizontally flowing air represented by arrow A which would otherwise be drawn into the entrance opening from the adjacent printing section 14. Similarly, the upward flow of air through slot 72' reduces the amount of horizontally flowing air represented by arrow B which would otherwise be drawn into the exit opening from the adjacent die cutter section 18. Therefore, substantially less air flows in the vicinity of the adjacent sections of the machine which significantly reduces the dust and ink-drying problems.

Figure 7:
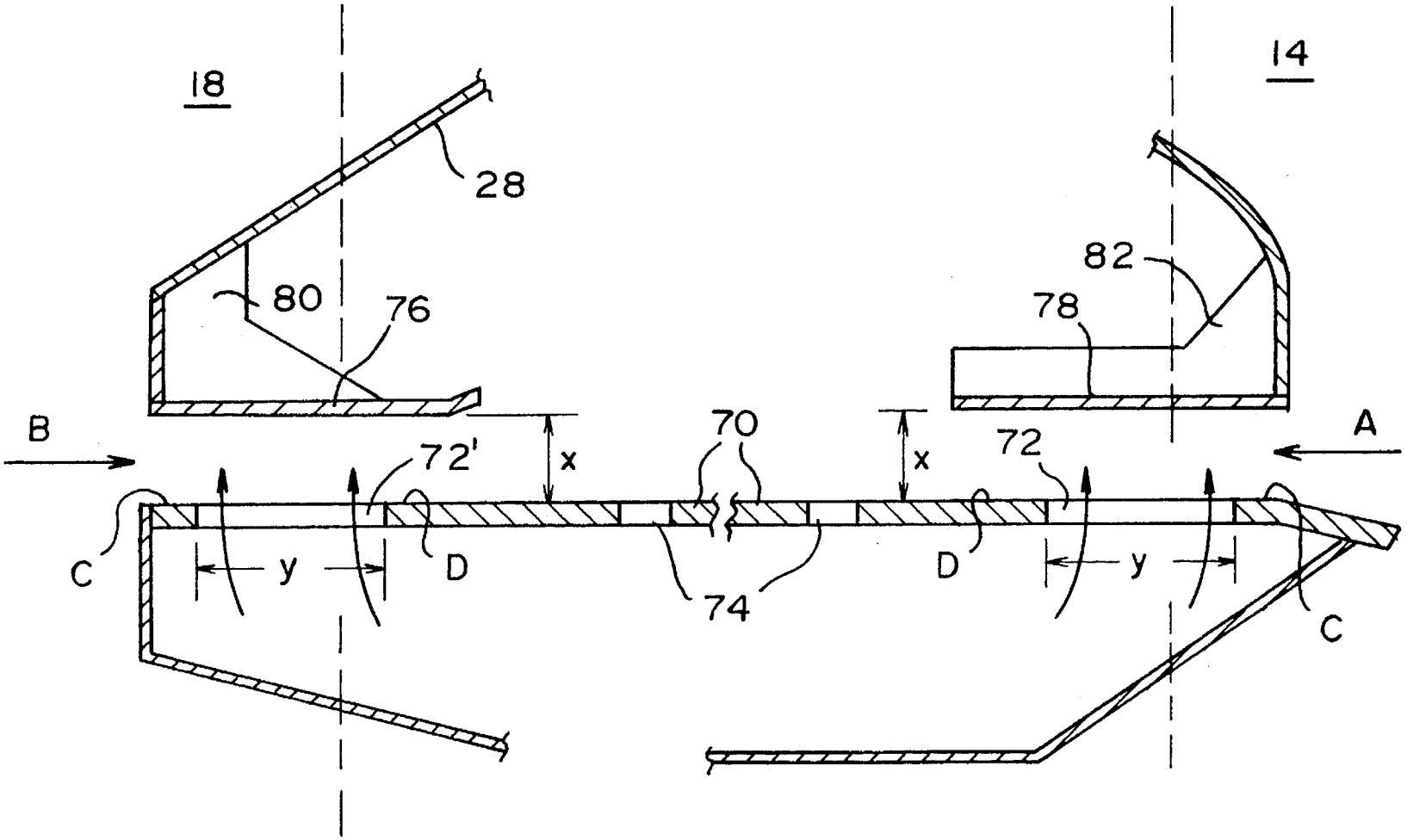
FIG. 7 is an enlarged, fragmentary side view, partly in section, showing the detail of the hood and closure plate.

In the preferred embodiment illustrated in FIG. 7, the lengths y of slots 72, 72'; ie, along the direction of travel of the blanks, is preferably made twice the vertical height X of the entrance and exit openings; the openings being defined by plate 70 and horizontally extending flow guide plates 76 and 78. Guide plates 76, 78 extend the width of hood 28 and may be secured to the lower edges of the hood by suitable support means such as brackets 80, 82, respectively. Guide plates 76, 78 extend into the transfer section a predetermined distance which is at least greater than the length of slots 72, 72'. This defines highly restricted, inlet and outlet flowpaths having restricted throat or gap areas C, D on both sides of each of slots 72 and 72'. In this manner, gap areas C control the flow of ambient air into the inlet and outlet portions of the hood, while gap areas D control the flow of mixed ambient air and air from the slots into the central region of the hood. With the length of slots 72, 72' being in the order of two times the height x of the gaps, and with these double gap areas on each side of the slots, the air flowing through the slots substantially reduces the horizontal air flow from adjacent sections represented by arrows A and B in FIG. 7.

In the previous description of the FIG. 1 and FIG. 5 embodiments, it has been assumed that the air flowing into the transfer section through the inlet and exit openings, as well as through the slots and apertures in the closure plate, is the ambient atmospheric air which surrounds the machine and is inside the machine in the adjacent sections. However, this ambient air frequently contains substantial amounts of dust, and particularly large amounts of microscopic pieces of the corrugated carton blanks being processed through the machine. Such contamination in the ambient air is undesirable and may cause problems such as clogging the print roll. Therefore, while the amount of mass flow of the air has been substantially reduced as previously described, the present invention further includes the provision of means for utilizing non-ambient air. That is, air from a controlled source whereby such air is substantially less contaminated with pollutants than the ambient air.

As illustrated in FIG. 5, the lower side of closure plate is preferably enclosed by ductwork 86 forming a plenum chamber 88 having an inlet 100. Inlet 100 may include a filter 102 for removing substantial amounts of pollutants, and inlet 100 may be connected to an external source of less polluted air such as a location away from the machine, or even outside the building in which the machine is being operated. Alternatively, inlet 100 may be connected to the discharge 104 of blower 32 by a duct as schematically illustrated by dotted line 106. Duct 106 may include a valve or damper 108 whereby all, or only some, of the air discharged by blower 32 may be recirculated to plenum chamber 88. Thus, the pressure of the air recirculated to the plenum may be varied, and it is preferred that the air be recirculated at a pressure in plenum 88 such as to be at essentially atmospheric pressure, or only slightly above atmospheric pressure. In this manner, the recirculated air flowing out of apertures 64 and slots 63 essentially balances the pressure of the ambient atmospheric air so that there is a minimum flow of air into the entrance and exit openings, thereby essentially eliminating the above-indicated problems caused by air flow in the adjacent sections of the machine.

It has also been discovered that the air flow within hood 28, and therefore the air flow against the blanks, may be further improved by the provision of baffles within the hood. For example, as shown in FIG. 5, horizontal baffles 110, 112 direct the flow of air horizontally into the center portion 114 of the hood, and vertical or angled baffles 116, 118 may be used to provide an upwardly extending flowpath 120 which guides the air directly into the center-intake of blower 32.

Alternatively, baffles angled like baffles 116, 118 may be provided so as to extend downwardly to the lower sides of the hood so as to reduce the total volume of the interior of the hood and direct the flow to the center of the hood.

Figure 4:
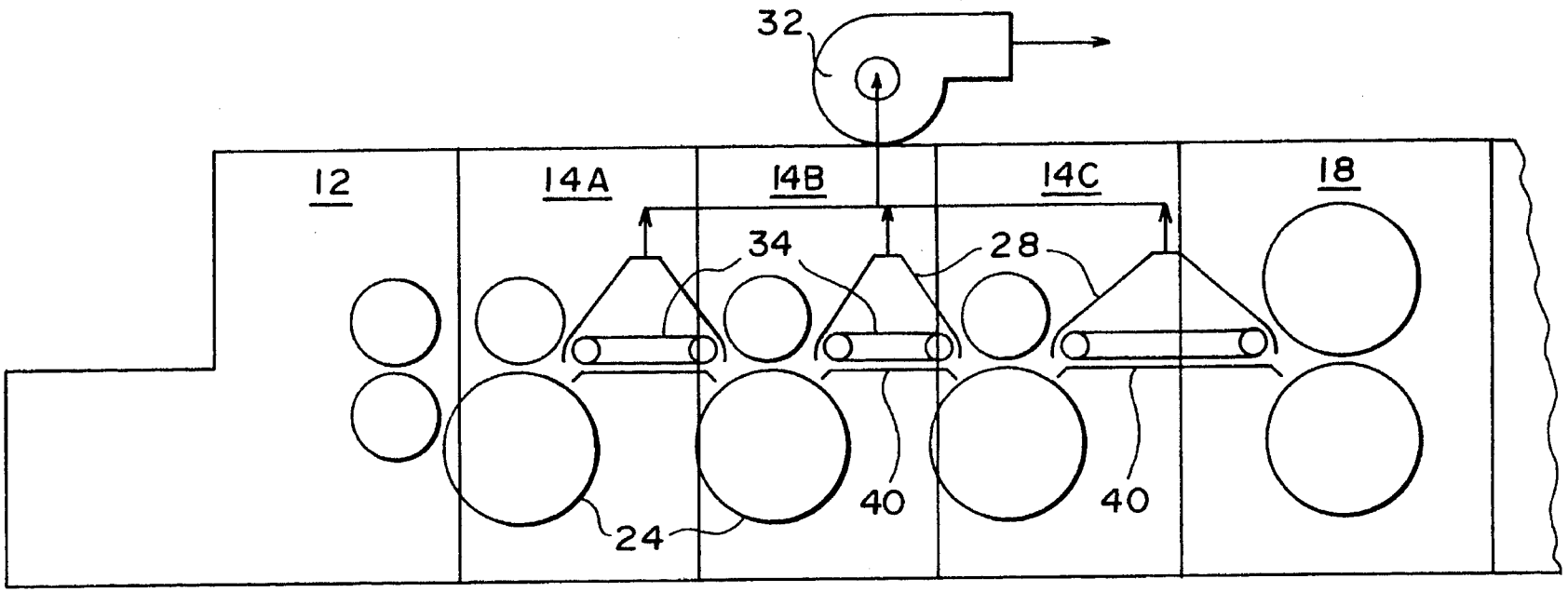
FIG. 4 is a schematic side view partly in cross-section showing a second embodiment of the present invention.
Figure 8:
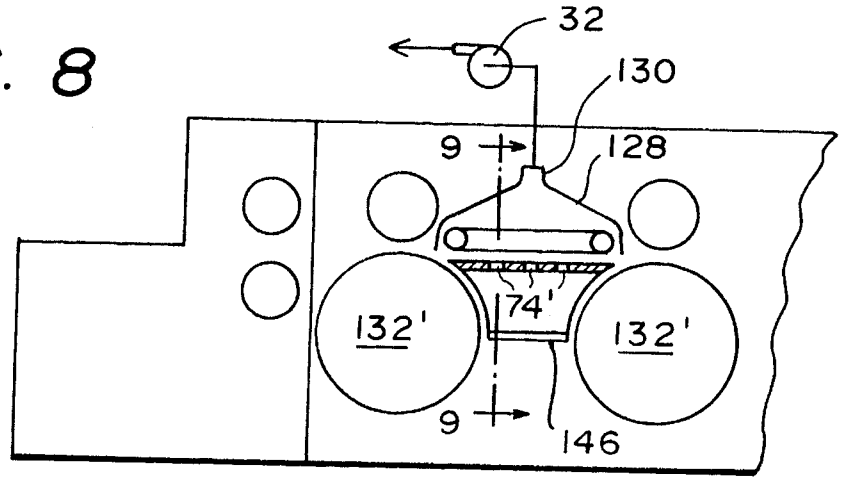
FIG. 8 is a schematic side view showing an alternative form of ducting air to the closure plate from a source of air above the print section of the machine.
Figure 9:
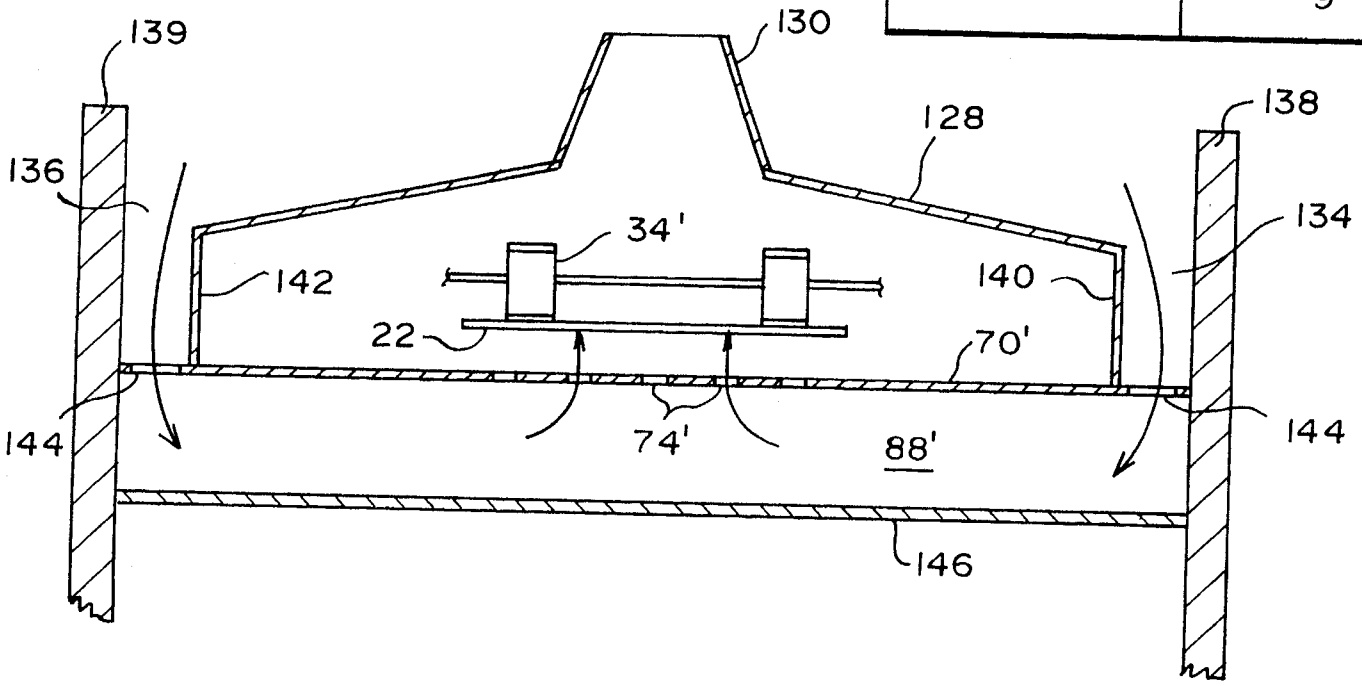
FIG. 9 is a simplified schematic view taken along view line 9—9 of FIG. 8.

As previously described, particularly with reference to FIG. 4, the transfer section of the present invention may be employed between multiple print sections. However, if the direction of the air flow is upwardly from below the print rolls, this air flow is objectionable for the reasons previously stated. Therefore, the present invention provides an alternative form of ducting when used between print sections. This ducting is illustrated in FIGS. 8 and 9 wherein it will be noted that hood 128 is less sloped than hood 28, and includes an outlet duct 130, but otherwise functions the same as hood 28. Similarly, this embodiment may include baffles corresponding to baffles 112 and 188 (not shown) and includes a plurality of conveyors 34' and a perforated closure plate 70', all of which function the same as their counterparts previously described. However, instead of the air flow coming from a location near the bottom of the machine, such as around or below print rolls 132', a pair of vertical ducts 134, 136 are provided at the opposite sides of the hood. For example, such ducts may be formed by the conventional side frame members 138, 139 and a pair of spaced vertical duct walls 140, 142. Walls 140, 142 extend to the bottom edge of hood 128 and terminate at or immediately adjacent perforated plate 70'. Plate 70' may extend to and be supported by frame members 138, 139 provided that sufficient openings 144 are provided in the plate to allow the required flow of air through vertical ducts 134, 136. Alternatively, the side edges of plate 70' may terminate adjacent duct walls 140, 142 if other means of support such as brackets are provided for the plate. At a spaced distance below plate 70' there is provided a horizontally extending sheet member 146 which forms the bottom of a plenum chamber 88'.

In this embodiment, the air flow is from the area at and above the upper surface of hood 128 and, as illustrated by flow arrows E and F, the air flows downwardly through ducts 134, 136 and into plenum 88' from which it flows upwardly through apertures 74' and against the blanks 22 which are forced into tight frictional contact with the lower reaches of conveyors 34'. In this manner, the air flow is prevented from flowing in contact with the print rolls 132' so that dust and drying problems are eliminated.

From the foregoing description it will be apparent that the present invention achieves high speed transport of blanks or sheets from one location to another by forcing the sheets upwardly against moving belts, without requiring vacuum holes in the belts, and with the expenditure of substantially less power than previously required while, at the same time, preventing or substantially reducing the amount of air flow from adjacent sections and providing for the firm engagement of the blanks or sheets against the conveyor belt even when the blanks or sheets are of small size relative to the width of the machine. It will also be understood that, instead of the sheets being forced upwardly against the belts, the system may be inverted with the suction hood located below the belts and the sheets pulled down against the upper reaches of the belts. These and other variations will become apparent to those skilled in the art such that it is to be expressly understood that the foregoing description is intended to be illustrative of the principles of the invention, rather than exhaustive thereof, and that the true scope of the present invention is not intended to be limited by the description of the preferred embodiments, nor limited other than as set forth in the following claims interpreted under the doctrine of equivalents.

What is claimed is:

1. A machine for processing paperboard sheets comprising:

(a) first and second processing sections;

(b) a transfer section located between said sections, said transfer section comprising a plurality of parallel conveyor belts extending from adjacent one of said sections to adjacent the other of said sections for transferring said sheets from said one section to said other section;

(c) means forming a chamber positioned above said plurality of conveyor belts, said chamber having a bottom portion surrounding said conveyor belts;

(d) a closure plate extending horizontally below said conveyor belts, said plate being of such size and shape such as to substantially close said bottom of said chamber and provide restricted airflow openings into said transfer section adjacent said first and second sections;

(e) a plurality of apertures in said closure plate for directing a secondary flow of air upwardly into said chamber;

(f) said chamber having an opening above said conveyor belts for the flow of air out of said chamber so as to create a subatmospheric pressure within said chamber surrounding said conveyor belts;

(g) air flow inducing means for drawing air out of said chamber through said opening and creating said subatmospheric pressure surrounding said conveyor belts such that said paperboard sheets are forced into frictional engagement with said conveyor belts and are transported by said belts from said one section to said other section; and (h) a plenum chamber below said closure plate.

2. The paperboard processing machine of claim 1 including filter means for filtering the air entering said plenum chamber.

3. The paperboard processing machine of claim 1 including duct means connecting said plenum chamber to the outlet of said air flow including means.

4. A machine for processing carton blanks comprising:

(a) first and second processing section;

(b) a transfer section positioned between said first and second sections;

(c) said transfer section including at least one conveyor 34 means for transferring said carton blanks from said first section to said second section;

(d) chamber means for creating a chamber of subatmospheric pressure above and surrounding said conveyor means;

(e) closure plate means extending horizontally a spaced distance below said conveyor means and forming restricted air inlet openings adjacent the ends of said conveyor means so as to create a pressure differential between the upper and lower surfaces of said carton blanks passing through said machine in engagement with the lower reach of said conveyor means and above said closure plate;

(f) said closure plate means including a plurality of apertures for the secondary flow of air therethrough; and (g) duct means for the flow of air from a position above said closure plate to a position below said closure plate.

5. The machine of claim 4 wherein said first section is a printing section and said second section is another printing section.

6. The machine of claim 4 wherein said duct means extend upwardly along the side of said chamber means to a position adjacent the top of said chamber means.

7. A machine for processing carton blanks comprising:

(a) first and second processing section;

(b) a transfer section positioned between said first and second sections;

(c) said transfer section including a plurality of conveyor belts having upper and lower reaches extending from adjacent said first section to adjacent said second section;

(d) means forming a chamber above and for creating a chamber of subatmospheric pressure above and surrounding said conveyor belts;

(e) blower means having an inlet connected to said chamber for creating a subatmospheric pressure in said chamber;

(f) closure plate means extending horizontally a spaced distance below said lower reaches of said conveyor belts and forming restricted air inlet openings adjacent opposite ends of said conveyor belts for the transfer of carton blanks therethrough in engagement with said lower reaches of said conveyor belts, said closure plate means extending horizontally a spaced distance below said lower reaches and below said carton blanks; and (g) a plurality of apertures in said closure plate for the secondary flow of air through said closure plate and upwardly against said carton blanks.

8. The paperboard processing machine of claim 7 wherein said plurality of apertures comprise a first density of apertures in the central region of said closure plate and a lesser density of apertures extending toward the side edges of said closure plate.

9. The processing machine of claim 7 further including slots in said closure plate adjacent the inlet and outlet ends thereof.

10. The processing machine of claim 7 wherein the total cross-sectional area of said apertures is in the order of 1 to 10 percent of the area of said closure plate between said slots.

11. A machine for processing carton blanks comprising:

(a) first and second sections;

(b) a transfer section positioned between said first and second sections;

(c) said transfer section including a plurality of conveyor belts having upper and lower reaches extending from adjacent said first section to adjacent said second section;

(d) means forming a chamber above and surrounding said conveyor belts;

(e) blower means having an inlet connected to said chamber forming means for creating a subatmospheric pressure in said chamber;

(f) closure plate means extending horizontally a spaced distance below said lower reaches of said conveyor belts and forming restricted air inlet openings adjacent opposite ends of said conveyor belts for the transfer of carton blanks therethrough in engagement with said lower reaches of said conveyor belts;

(g) a plurality of apertures in said closure plate for the secondary flow of air through said closure plate and upwardly against said carton blanks; and (h) means forming a plenum chamber below said closure plate.

12. The machine of claim 11 including filter means for filtering the air flowing into said plenum chamber.

13. The machine of claim 11 including duct means for recirculating at least some of the air from said blower means to said plenum chamber.

14. The machine of claim 11 wherein said plurality of apertures have a first density in the central region of said closure plate and a second density of apertures outside of said central region, said first density being greater than said second density.

15. The machine of claim 11 wherein said plurality of apertures further include a plurality of slots, said slots being positioned adjacent the inlet and outlet edges of said closure plate.

16. The machine of claim 11 wherein each of said first and second sections comprise printing sections.

17. The machine of claim 16 further including duct means for the flow of air from a position above said closure plate to said plenum chamber and then upwardly through said closure plate.

* * * * *